US012037187B2

(12) United States Patent
Collins et al.

(10) Patent No.: US 12,037,187 B2
(45) Date of Patent: Jul. 16, 2024

(54) METHODS AND SYSTEMS FOR REMOTE OPENING AND MONITORING OF AN ACCESS HATCH

(71) Applicant: Conspec Controls, Inc., Burlington (CA)

(72) Inventors: Robert E. Collins, Pittsburgh, PA (US); Paul Douglas Boyce, Fairmont, WV (US)

(73) Assignee: Conspec Controls, Inc., Burlington, CA (US)

( * ) Notice: Subject to any disclaimer, the term of this patent is extended or adjusted under 35 U.S.C. 154(b) by 0 days.

(21) Appl. No.: 18/338,776

(22) Filed: Jun. 21, 2023

(65) Prior Publication Data

US 2023/0339675 A1 Oct. 26, 2023

Related U.S. Application Data

(63) Continuation-in-part of application No. 16/769,676, filed as application No. PCT/US2019/063169 on Nov. 26, 2019, now Pat. No. 11,760,565.

(60) Provisional application No. 62/771,425, filed on Nov. 26, 2018.

(51) Int. Cl.

| | |
|---|---|
| ***B65D 90/10*** | (2006.01) |
| ***B65D 90/62*** | (2006.01) |
| ***B65D 90/66*** | (2006.01) |

(52) U.S. Cl.

CPC ..... *B65D 90/10* (2013.01); *B65D 90/623* (2013.01); *B65D 90/66* (2013.01)

(58) Field of Classification Search

CPC ..... B65D 90/10; B65D 90/623; B65D 90/34; B65D 90/62; B65D 90/32; E05F 11/04; E05F 11/12; E05F 15/627

See application file for complete search history.

(56) References Cited

U.S. PATENT DOCUMENTS

| | | | | |
|---|---|---|---|---|
| 3,733,750 A * | 5/1973 | Hege | B65D 90/34 | 52/192 |
| 3,733,764 A * | 5/1973 | Hege | B65D 90/623 | 52/192 |
| 4,208,839 A * | 6/1980 | Candy, Sr. | B65D 90/10 | 49/357 |
| 4,327,522 A * | 5/1982 | Meadows | B65D 90/10 | 49/357 |
| 4,625,888 A * | 12/1986 | Thompson | B65D 90/623 | 49/404 |

(Continued)

*Primary Examiner* — Justin B Rephann

(74) *Attorney, Agent, or Firm* — Vorys, Sater, Seymour and Pease LLP

(57) ABSTRACT

A storage tank includes a floor, a roof, a sidewall extending between the floor and the roof, an access hatch provided on the roof and having a base, a lid pivotably coupled to the base, and a latch configured to secure the lid to the base in a closed position, and a system for remotely opening and closing the access hatch. The system includes an elongate arm having a proximal end operatively coupled to the lid, a pull cable attached to a distal end of the elongate arm and extending toward a ground adjacent the storage tank, and a latching cable attached to the latch and extending toward the ground adjacent the storage tank, wherein pulling on the latching cable when the lid is in the closed position actuates the latch to secure the lid to the base in the closed position.

20 Claims, 6 Drawing Sheets

(56) References Cited

U.S. PATENT DOCUMENTS

| | | | | | |
|---|---|---|---|---|---|
| 4,744,183 | A * | 5/1988 | Kruger | B65D 90/623 | 220/264 |
| 4,747,244 | A * | 5/1988 | Christianson | B65D 90/10 | 220/264 |
| 5,218,784 | A * | 6/1993 | Pollock | E05F 11/04 | 52/192 |
| 5,566,506 | A * | 10/1996 | Phillips | B65D 90/10 | 52/192 |
| 5,839,597 | A * | 11/1998 | Marttila | B65D 90/10 | 220/264 |
| 7,093,733 | B2 * | 8/2006 | Nishimura | B01J 3/03 | 220/829 |
| 8,196,362 | B1 * | 6/2012 | Ratts | E05F 11/12 | 52/192 |
| 8,375,637 | B2 * | 2/2013 | Zazula | E05F 11/04 | 49/357 |

* cited by examiner

METHODS AND SYSTEMS FOR REMOTE OPENING AND MONITORING OF AN ACCESS HATCH

CROSS-REFERENCE TO RELATED APPLICATION

The present application is a continuation-in-part claiming priority to U.S. patent application Ser. No. 16/769,676 entitled "Methods and Systems for Remote Opening and Monitoring of an Access Hatch," filed on Jun. 4, 2020.

BACKGROUND

In the oil and gas industry, various types of storage tanks are used during hydrocarbon production processes to contain liquids and gases, such as oil, crude oil, raw natural gas, refined products, drip gas, etc. The liquids and gases contained within oilfield storage tanks often emit (produce) volatile organic compounds (VOCs), and the storage tanks are designed to contain the liquids and gases within the interior, while simultaneously preventing harmful VOCs from being vented into the surrounding atmosphere. These storage tanks can be constructed of virtually any industrial material, such as metal (e.g., stainless steel), plastics, or composite materials (e.g., fiberglass).

In most storage tank designs, a manhole or access hatch is provided on the roof of the storage tank to enable tank operators (workers) to access the interior of the tank. Commonly known in the oil and gas industry as "thief hatches," these access hatches enable tank operators to visually inspect and gauge the contents of the storage tank, as well as obtain samples of the fluids stored therein. Sampling the fluids within a storage tank typically entails the tank operator manually opening the access hatch on the roof, introducing collection and measurement tools through the access hatch and into the tank, and subsequently retrieving the tools containing a fluid sample.

Opening storage tank access hatches can be hazardous to workers since this allows accumulated VOCs and other toxic vapors or gases to rapidly escape through the access hatch to the surrounding environment. This exposes workers in the same vicinity to hazardous conditions, such as elevated concentrations of hydrocarbon gas and vapor, an oxygen-deficient atmosphere, and the potential for combustion (fire) and/or explosions. Loss of consciousness and even death have been reported as a result of VOCs escaping through opened access hatches. The National Institute for Occupational Safety and Health (NIOSH) and the Occupational Safety and Health Administration (OSHA), for instance, have identified nine worker fatalities that occurred while workers manually gauged or sampled production tanks from 2010-2014. Exposure to VOCs and other toxic gases and vapors and/or oxygen-deficient atmospheres are believed to be the primary or contributory factors to the workers' deaths.

Aside from the use of better personal protective equipment and more effective education on the risks associated with manual access hatch manipulation, the only methods currently used to reduce worker exposure to VOCs released via access hatches are methods of remotely monitoring the contents of the oilfield storage tank. Remote methods, however, do not address worker safety when visual inspection, sampling, and maintenance are required.

In addition to the risk to workers' lives, the Environmental Protection Agency (EPA) has identified access hatches as a source of unchecked release of VOCs into the atmosphere. Unchecked VOC release can occur in a variety of ways.

First, tank operators may inadvertently leave the access hatch open following fluid sampling. Second, tank operators might shut the access hatch, but fail to securely latch the access hatch in the closed position. Generally, access hatches are relatively lightweight and will not substantially reduce the flow of VOCs into the atmosphere unless the lid is securely latched to its base. Poor maintenance practices and standards for access hatches are also a major contributing factor to VOC leakage.

Solutions to the foregoing issues common to current oilfield storage tank designs is desired to both improve worker safety and remedy unchecked release of VOCs into the atmosphere.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure is related to storage tanks used in the oil and gas industry and, more particularly, to systems for remotely opening and closing a storage tank access hatch that improves worker safety during inspecting and sampling fluids.

As used herein, the term "off-gas," "off-gases," or any variation thereof refers to gases and/or vapors that are released into the surrounding atmosphere upon opening an access hatch of a storage tank. Off-gases can be especially dangerous to the health and safety of tank operators or workers. One form of off-gas is volatile organic compounds (VOCs), which comprise dissolved hydrocarbon gases released from petroleum hydrocarbons. Example VOCs include, but are not limited to, methane, ethane, propane, butane, hexane, benzene, and xylene. Other types of off-gases can be toxic or harmful gases and/or vapors and can include, but are not limited to, hydrogen sulfide, nitrogen, carbon dioxide, isobutane, isopentane, n-pentane, and heptanes plus.

The present disclosure provides systems and methods for improving worker safety during inspection and sampling from access hatches on oilfield tanks, natural gas tanks, production tanks, and flow back tanks, through remote opening of the access hatch and monitoring and reporting the presence of escaping off-gases from the access hatch. Monitoring and reporting will improve worker safety by identifying when off-gas levels are below a safety threshold so that a worker may climb to the access hatch for inspection and sampling both after opening and during storage. Monitoring and reporting will also improve unchecked release of off-gases into the atmosphere, as leaks will be more readily detected and reported so that they may be rectified.

In addition to being able to remotely open the access hatch from the ground, the systems described herein also include a monitoring system that monitors the environment surrounding the access hatch and notifies tank operators when it is safe to approach the access hatch for inspecting and sampling of the liquid inside. Thus, the present disclosure also provides mechanisms and methods for monitoring the area around the access hatch for volatile gases that may be toxic, in order to warn workers to stay away from the area near the access hatch, or to indicate a leak.

Further, in some situations, the access hatch may be deemed unsafe to approach after some time in the open position or may need to be rapidly shut after opening. In these situations, the access hatch may need to be closed and latched remotely, as manual latching of the access hatch may submit an operator to unsafe conditions. Accordingly, the present disclosure provides systems and methods for closing and latching the access hatch remotely without the need for manual actuation or the presence of an operator near the access hatch. Thus, worker safety may be further improved with the ability to unlatch and open, or close and latch the access hatch from a safe distance.

Figure 1:
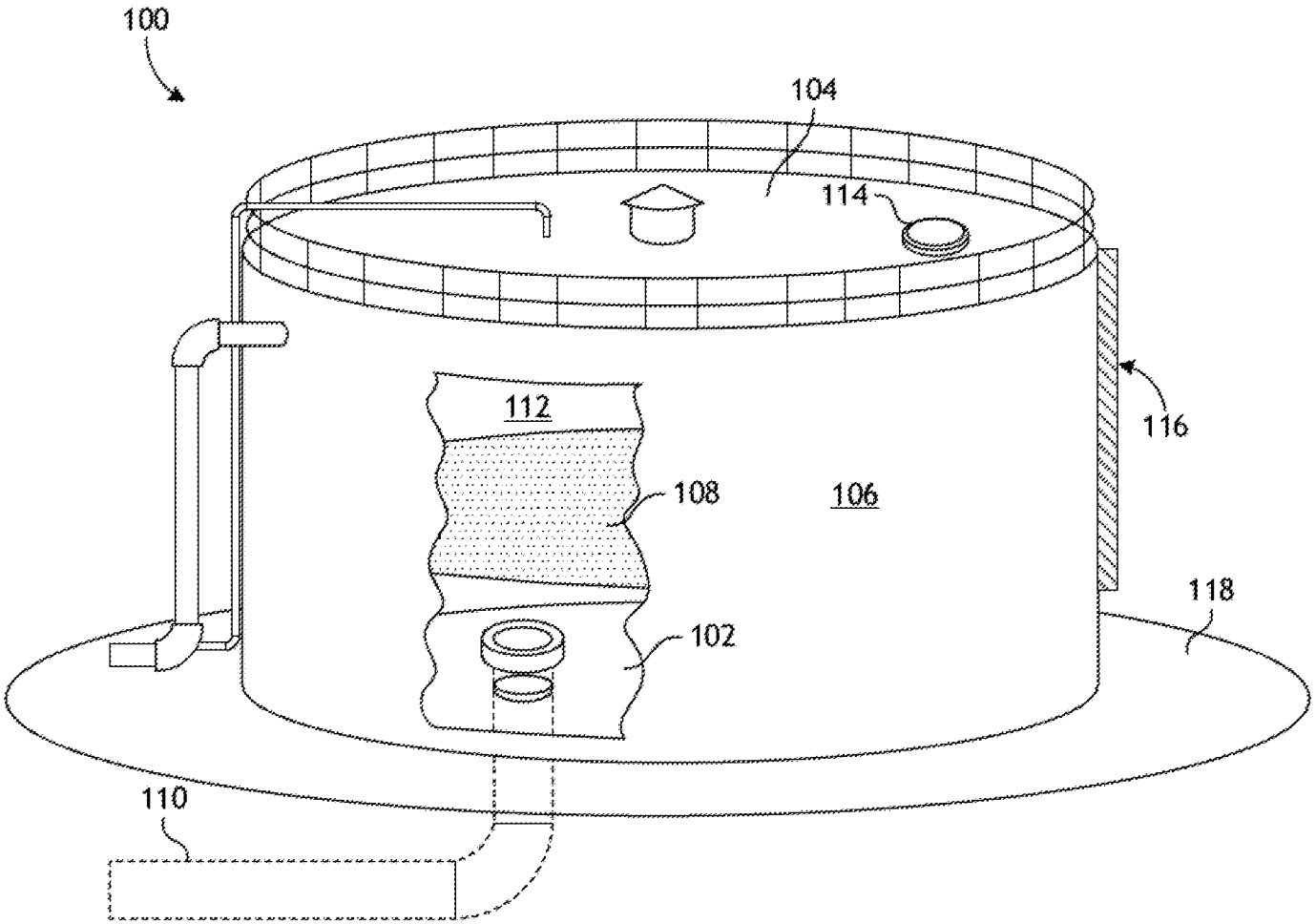
FIG. 1 PRIOR ART
FIG. 1 is a prior art storage tank that may incorporate the principles of the present disclosure.

FIG. 1 is a prior art storage tank 100 that may incorporate the principles of the present disclosure. The storage tank 100, alternately referred to as a "condensate tank" or a "stock tank", may be configured to contain various types of fluids (e.g., liquids and/or gases) related to the oil and gas industry. Common fluids that might be contained within the storage tank 100 include, but are not limited to, oil, crude oil, raw natural gas, refined products, drip gas, cycled concentrations of brine water, other well liquids and chemicals, or any combination thereof.

As illustrated, the storage tank 100 includes a floor 102, a roof 104, and an exterior shell or sidewall 106 extending between the floor 102 and the roof 104. In some examples, as depicted, the sidewall 106 may comprise a continuous, curved structural member that forms a circular or oval wall for the storage tank 100. In other applications, however, the geometric shape of the storage tank 100 may be polygonal (e.g., square, rectangular, etc.). The floor 102, the roof 104, and the sidewall 106 are all suitably connected, sealed, and otherwise constructed to contain liquids and gases within the interior of the storage tank 100.

In the illustrated example, a liquid 108 is contained within the interior of the storage tank 100 and may be fed into the interior via one or more pipes 110. A gas 112 may also be present within the interior above the liquid 108 and, in some cases, may originate from the liquid 108 as a gaseous discharge or emission. In some applications, the gas 112 includes accumulated off-gases emitted from the liquid 108. The storage tank 100 operates, in part, to prevent the off-gases from being inadvertently released into the surrounding environment.

The storage tank 100 also includes an access hatch 114 provided on the roof 104. The access hatch 114, alternately referred to in the industry as a "thief hatch," is accessible by a tank operator (worker) via a ladder 116 coupled to the sidewall 106. While only one access hatch 114 is depicted in FIG. 1, the storage tank 100 may include more than one access hatch 114, without departing from the scope of the disclosure. The access hatch 114 provides an access point for a worker to visually inspect the contents of the storage tank 100 and obtain samples of the liquid 108 as needed. The act of obtaining a sample of the fluid 108 via the access hatch 114 is sometimes referred to as "thieving". After ascending the ladder 116 and locating the access hatch 114 on the roof 104, the worker will typically manually open the access hatch 114, following which one or more collection and/or measurement tools may be manually introduced into the interior of the storage tank 100 via the open access hatch 114.

With conventional storage tanks, manually opening the access hatch 114 while on the roof 104 can be dangerous for the tank operator (worker) and potentially result in loss of consciousness or even death. More specifically, opening the access hatch 114 allows accumulated off-gases in the gas phase 112 to escape into the surrounding environment via the access hatch 114, which could be inhaled and otherwise ingested (absorbed) by the tank operator. The escaping off-gases may also create an oxygen-deficient atmosphere, or potentially combust or explode, and thereby further put the health and safety of the tank operator at risk.

According to embodiments of the present disclosure, the access hatch 114 may include, or otherwise be retrofitted with, a system for remotely opening the access hatch 114, which places the worker at a safe distance from any off-gases escaping from the access hatch 114. As described herein, the system includes a series of pulleys and counterweights that allow a tank operator (worker) to open the access hatch 114 while located on the ground 118 adjacent the storage tank 100. In some embodiments, the system may also include one or more sensors that monitor the access hatch 114 and the environment surrounding the access hatch 114. In such embodiments, the sensors may notify the tank operator on the ground 118 when it is safe to ascend the ladder 116 and approach the access hatch 114 on the roof 104.

Figure 2A:
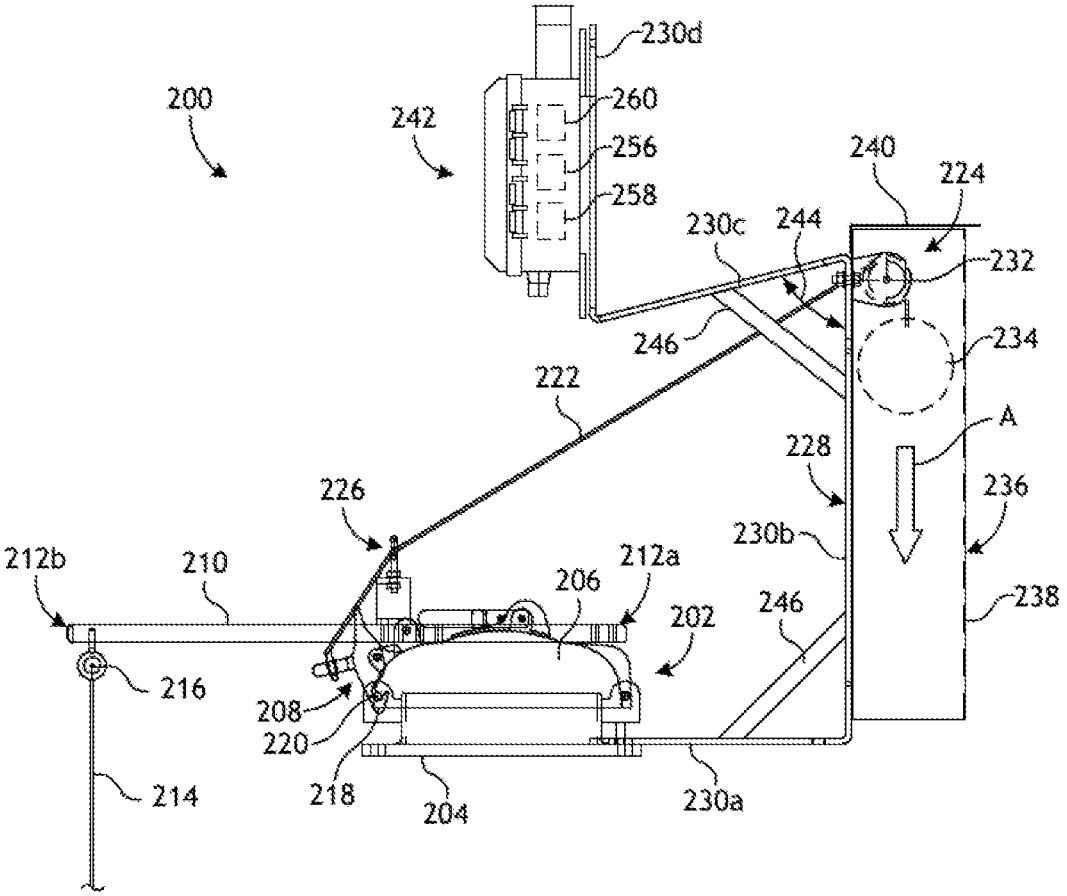
FIGS. 2A-2C are side, top and front views, respectively, of an example system for remotely operating an access hatch, according to one or more embodiments.
Figure 2B:
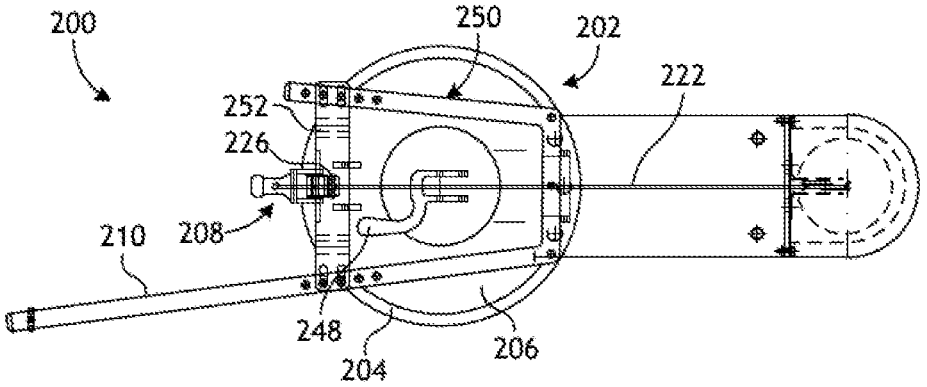
Figure 2C:
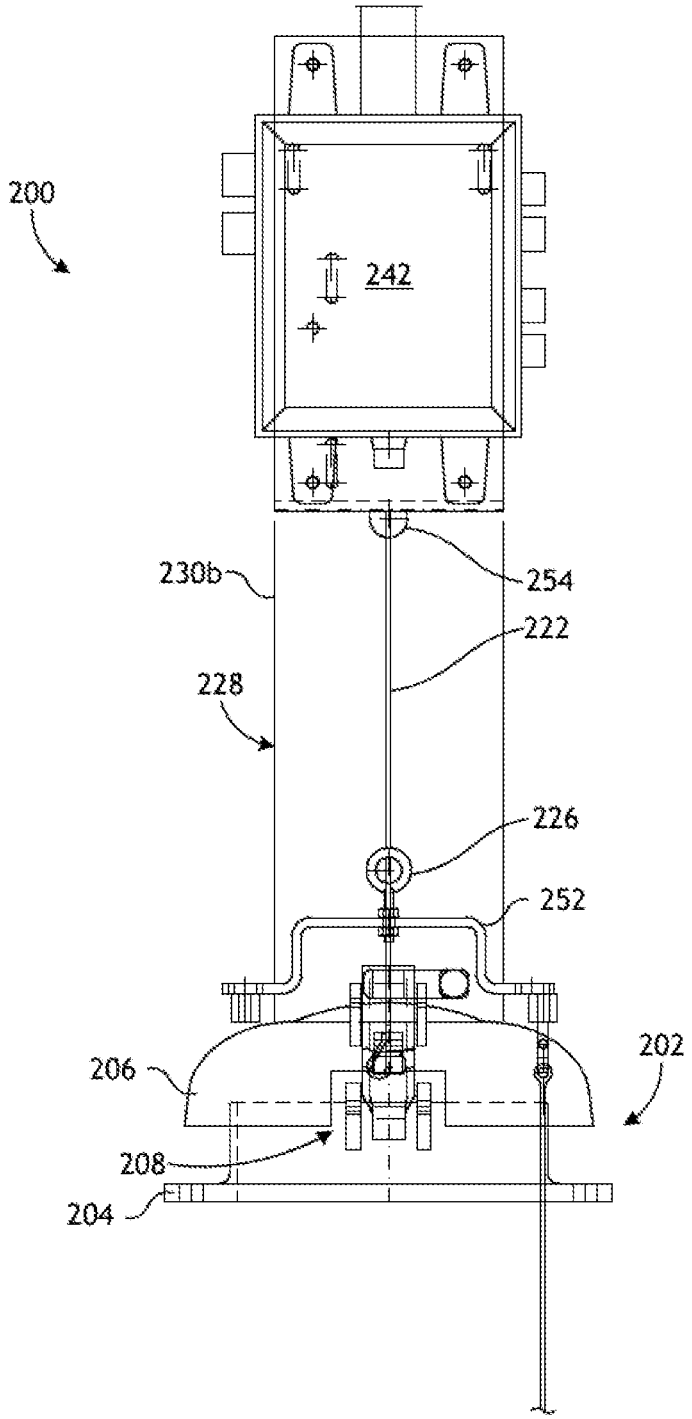

FIGS. 2A-2C are side, top, and front views, respectively, of an example system 200 for remotely operating an access hatch 202. The access hatch 202 may be the same as or similar to the access hatch 114 of FIG. 1 and, therefore, may be installed in or otherwise form part of the storage tank 100 (FIG. 1). The following discussion will describe and discuss the system 200 and the access hatch 202 as being used in conjunction with the storage tank 100. However, it should be noted that the system 200 may alternately be used in conjunction with other types of access hatches 202, and the access hatch 202 may alternately be used in conjunction with other types of storage tanks 100. Consequently, the system 200 is not limited to use with the access hatch 202 or the storage tank 100 described herein.

In some embodiments, the access hatch 202 may comprise an existing thief hatch and the system 200 can be retrofitted onto the access hatch 202. In other embodiments, however, the system 200 may form an integral part of the design and manufacture of the access hatch 202, without departing from the scope of the disclosure. As illustrated, the access hatch 202 includes a base 204, a lid 206 pivotably coupled to the base 204, and a latch 208 used to secure the lid 206 to the base 204 in a closed position.

Referring first to FIG. 2A, the system 200 includes an elongate arm 210 having a first or "proximal" end **212*a* and a second or "distal" end 212*b* opposite the proximal end 212*a*. At or near the proximal end 212*a*, the arm 210 may be operatively coupled to the lid 206. As used herein, the term "operatively coupled" refers to an indirect or direct coupling of one member (e.g., the arm 210) to a second member (e.g., the lid 206). The arm 210 extends from the lid 206 and may have a length sufficient such that the distal end 212*b* extends past an outer perimeter of the storage tank 100 (FIG. 1**).

A pull cable 214 may be attached to the arm 210 at or near the distal end **212*b*. The pull cable 214 may be made of a variety of materials including, but not limited to, a metal (e.g., steel, stainless steel, aluminum, etc.), metal fibers, synthetic fibers (e.g., KEVLAR®, nylon, etc.), natural fibers, a belt, a chain, a rope, or any combination thereof. The pull cable 214 may be operatively coupled to the arm 210 at an attachment mechanism 216. In the illustrated embodiment, the attachment mechanism 216 comprises an eyebolt or the like, but could alternatively comprise any other type of attachment device or apparatus capable of coupling the pull cable 214 to the arm 210**, such as a swivel lifting ring.

The access hatch 202 is depicted in FIGS. 2A-2C in the closed position, with the lid 206 being secured to the base 204 using the latch 208. When the access hatch 202 is in the closed position, the lid 206 substantially prevents off-gases from escaping from the interior of the storage tank 100 (FIG. 1). In some embodiments, as illustrated, the latch 208 may be rotatably coupled to the lid 206, but could alternatively be rotatably coupled to the base 204, without departing from the scope of the disclosure. The latch 208 provides or otherwise defines a catch 218 matable with a pin 220 provided on the base 204. In some embodiments, the latch 208 is spring-loaded and otherwise biased toward a position where the catch 218 is able to locate and mate with the pin 220. In other embodiments, however, the latch 208 may not be spring-loaded, without departing from the scope of the disclosure.

The latch 208 is depicted in FIG. 2A in a latched position, where the catch 218 is mated with the pin 220. A weight cable 222 may be operatively coupled to the latch 208 and configured to constantly urge the latch 208 to an unlatched position, where the catch 218 is released from the pin 220. When the latch 208 is in the unlatched position, the lid 206 will be free to pivot open relative to the base 204. In the illustrated embodiment, the weight cable 222 is operatively coupled to a projection extending laterally from the latch 208, but could alternatively be coupled to other portions of the latch 208, without departing from the scope of the disclosure. The weight cable 222 may be made of any of the materials mentioned herein for the pull cable 214.

The weight cable 222 extends from the latch 208 and to a pulley system 224 included in the system 200. In some embodiments, as illustrated, the weight cable 222 may extend through a guide 226 operatively coupled to the lid 206. The guide 226 may be configured to guide and control the displacement of the weight cable 222 as the lid 206 is opened and the access hatch 202 is moved to the open position. In at least one embodiment, the guide 226 may comprise an eyebolt and the weight cable 222 may extend through the aperture defined by the eyebolt. In other embodiments, however, the guide 226 may comprise a swivel lifting ring or the like, without departing from the scope of the disclosure.

As illustrated, the pulley system 224 is mounted to a support frame 228 operatively coupled to the access hatch 202 and, more particularly, to the base 204. The support frame 228 includes at least a first member **230*a* and a second member 230*b* that extends from the first member 230*a*. In the illustrated embodiment, the first member 230*a* extends substantially horizontal from the base 204, and the second member 230*b* extends substantially orthogonal to the first member 230*a*. In other embodiments, however, the angular disposition of the first and second members 230*a,b* may be altered to fit particular applications. For example, it may not be necessary that the second member 230*b* extend orthogonal to the first member 230*a***.

The pulley system 224 may be mounted to the support frame 228 at or near the top of the second member **230*b*, and the weight cable 222 may extend through an aperture or cutout (not visible in FIG. 2A, see FIG. 2C) defined in the second member 230*b* to access the pulley system 224. As illustrated, the pulley system 224 includes one or more sheaves 232 (one shown), and the weight cable 222 is fed through or otherwise routed around the sheave(s) 232, and a counterweight 234 is coupled to the end of the weight cable 222. The counterweight 234 exhibits a weight sufficient to lift and otherwise force the lid 206 to pivot from the closed position to the open position. Once the latch 208 is detached from the pin 220, the gravitational pull of the counterweight 234 coupled to the end of the weight cable 222 will act (pull) on the weight cable 222 in the direction indicated by the arrow A. The weight cable 222 will correspondingly exert a force on the lid 206 at the latch 208 to open the access hatch 202**.

As will be appreciated, the particular weight of the counterweight 234 may depend on the given weight of the lid 206, and may otherwise be optimized to ensure a slow but steady descent in the direction A. Moreover, the worker may simply allow the pull cable 214 to slowly retract to ensure a slow but steady descent of the counterweight 234. The counterweight 234 may be made of a variety of dense or heavy materials such as, but not limited to, a metal (e.g., iron, steel, lead, etc.), a natural material (e.g., sand, rock(s), water, etc.), concrete or cement, a plastic, a resin, or any combination thereof.

In some embodiments, the pulley system 224 and the counterweight 234 may be arranged within a weight guard 236 operatively coupled to or forming part of the support frame 228. In some embodiments, as illustrated, the weight guard 236 may include a sidewall 238 and a cover plate 240 covering the top of the sidewall 238. In at least one embodiment, the sidewall 238 may be arcuate or curved and attached to the second member **230*b* at opposing ends. In other embodiments, however, the shape of the sidewall 238 may exhibit any other geometric shapes suitable for receiving and enclosing the pulley system 224 and the counterweight 234**, without departing from the scope of the disclosure.

In some embodiments, the weight guard 236 may operate as a weather cover configured to prevent snow or debris from accumulating on the pulley system 224 and the counterweight 234, which might otherwise result in malfunction of either component. In addition, the weight guard 236 may also operate as a safety feature. More specifically, if the weight cable 222 fails and the counterweight 234 drops to the roof 104 (FIG. 1), the weight guard 236 may be configured to contain the counterweight 234 so that it does not roll off the roof 104 and potentially strike and injure a tank operator (or any other person) located on the ground 118 (FIG. 1).

The system 200 may further include a monitoring system 242. In some embodiments, as illustrated, the monitoring system 242 may be mounted to the support frame 228 and generally arranged above the access hatch 202. More specifically, the support frame 228 may include a third member **230*c* that extends from the second member 230*b*, and a fourth member 230*d* that extends from the third member 230*c*, and the monitoring system 242 may be mounted to the fourth member 230*d*. In at least one embodiment, as illustrated, the third member 230*c* may extend from the second member 230*b* at an acute angle 244. In other embodiments, however, the third member 230*c* may extend perpendicular to the second member 230*b*, without departing from the scope of the disclosure. Having the third member 230*c* extend at the acute angle 244, however, may prove advantageous in allowing the monitoring system 242 to be placed closer to the access hatch 202. The acute angle 244 may comprise any angle ranging between about 45° and about 85°, but could alternatively be less than 45° or greater than 85° depending on the design of the system 200 and the configuration of the access hatch 202**.

In some embodiments, as illustrated, the fourth member 230*d* may extend substantially vertical from the third member 230*c* to provide a vertical mounting location for the monitoring system 242. In other embodiments, however, the fourth member 230*d* may extend from the third member 230*c* at other suitable orientations or angles sufficient to locate the monitoring system 242 in proximity to the access hatch 202. While the monitoring system 242 is shown mounted above the access hatch 202, it is contemplated herein to mount the monitoring system 242 in any space that allows measurement of the area above and around the access hatch 202, such as laterally adjacent the access hatch 202.

The monitoring system 242 may include one or more sensors or gauges configured to monitor the state of the access hatch 202 and the area around the access hatch 202 for off-gases or any other emissions that may be toxic or harmful to humans. In some embodiments, the monitoring system 242 may also include an alert system configured to provide tank operators (workers) with visual, audible, or digital alerts regarding conditions around the access hatch 202, thus ensuring that tank operators do not approach the access hatch 202 when the environment is unsuitable for humans.

In some embodiments, the support frame 228 may further include one or more support members or "gussets" 246 installed to help support the support frame 228. In the illustrated embodiment, support members 246 are installed and extend between the first and second members 230*a,b*, and between the second and third members 230*a,b*. As will be appreciated, more or less than two support members 246 may be included in the support frame 228 and may be located at any suitable location needed to adequately buttress the support frame 228.

FIG. 2B depicts a top view of the system 200. In some embodiments, the access hatch 202 may include a handle 248 operatively coupled to the lid 206. As illustrated, the system 200 may further include a frame 250 secured to the lid 206. The frame 250 may be removably or permanently secured to the lid 206 in various ways. In some embodiments, for example, the frame 250 may be removably secured to the lid 206 using one or more mechanical fasteners such as, but not limited to, bolts, clamps, tie downs, magnets, or any combination thereof. In other embodiments, the frame 250 may be permanently secured to the lid 206 by welding, an adhesive, or any combination thereof.

In one or more embodiments, as illustrated, the frame 250 may include four interconnected members that generally form a trapezoidal shape over the lid 206 when viewed from above. One of the interconnected members may be the arm 210, which extends away from the access hatch 202. Another of the interconnected members is a cross member 252, which provides a location to mount the guide 226 for the weight cable 222. As will be appreciated, various other configurations or designs for the frame 250 may be employed, and will depend primarily on the size and shape of the lid 206. For example, the interconnected members of the frame 250 may alternatively form other geometric shapes (e.g., triangular, square, rectangular, circular, oval, ovoid, etc.), without departing from the scope of the disclosure. The frame 250 may be made of any rigid material capable of transferring a downward force on the lid 206 including, but not limited to, a metal (e.g., aluminum, iron, steel, etc.), wood, a plastic, resin, a composite material, or any combination thereof.

FIG. 2C depicts a front view of the system 200. As illustrated, the weight cable 222 extends from the latch 208 and through the guide 226 mounted to the cross member 252 above the lid 206. Moreover, the weight cable 222 penetrates the support frame 228 via an aperture 254 defined in the second member 230*b* to access the pulley system 224 (FIG. 2A). Also illustrated in FIG. 2C is the monitoring system 242 generally arranged above the access hatch 202.

Figure 3A:
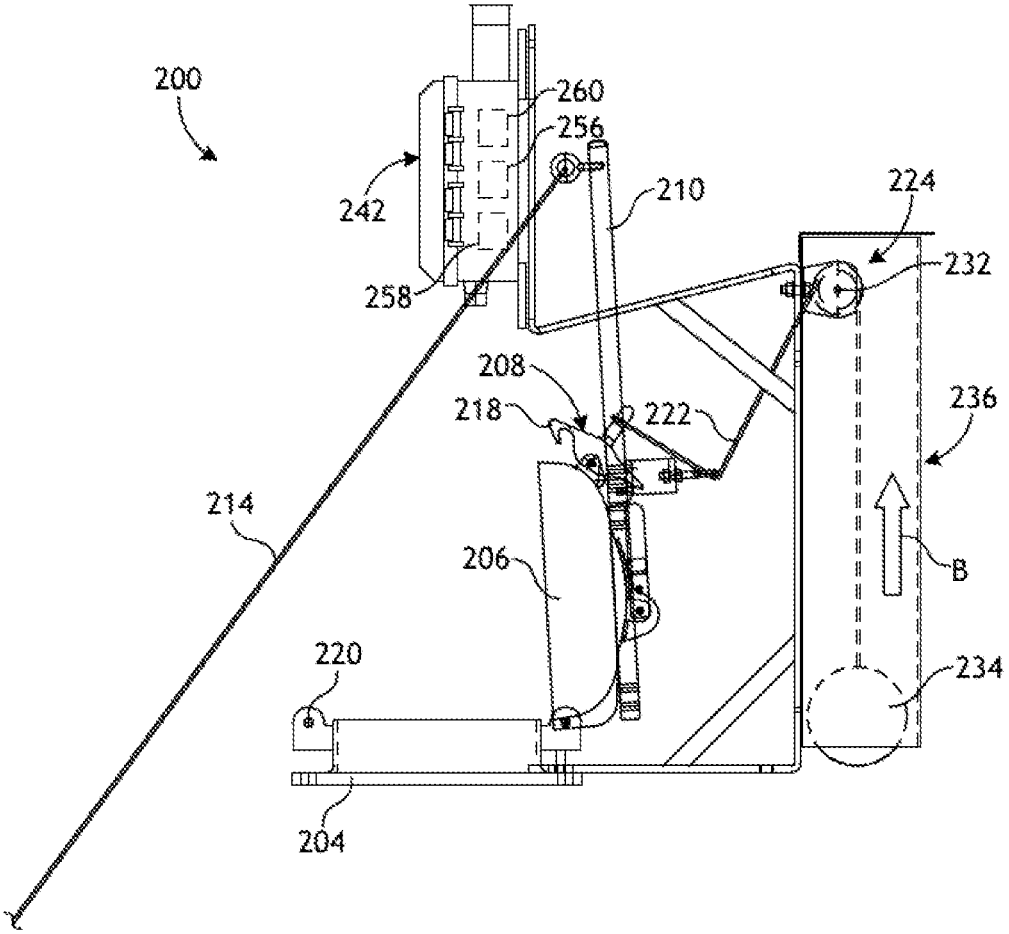
FIGS. 3A-3C are side, top and front views, respectively, of the system of FIGS. 2A-2C with the access hatch in the open position.
Figure 3B:
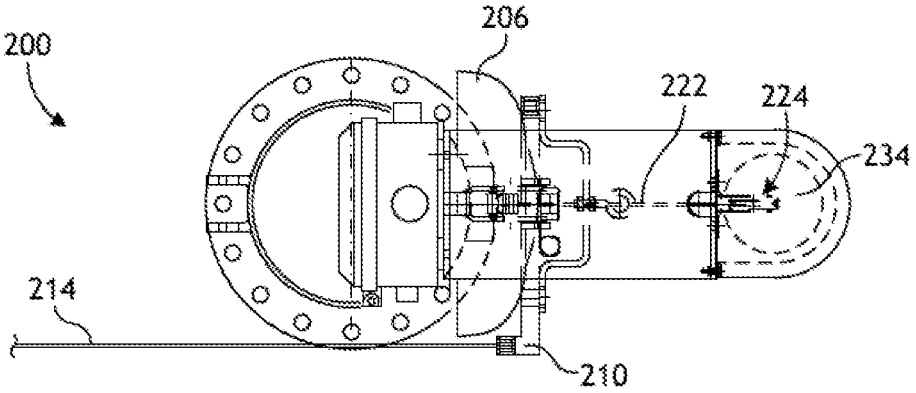
Figure 3C:
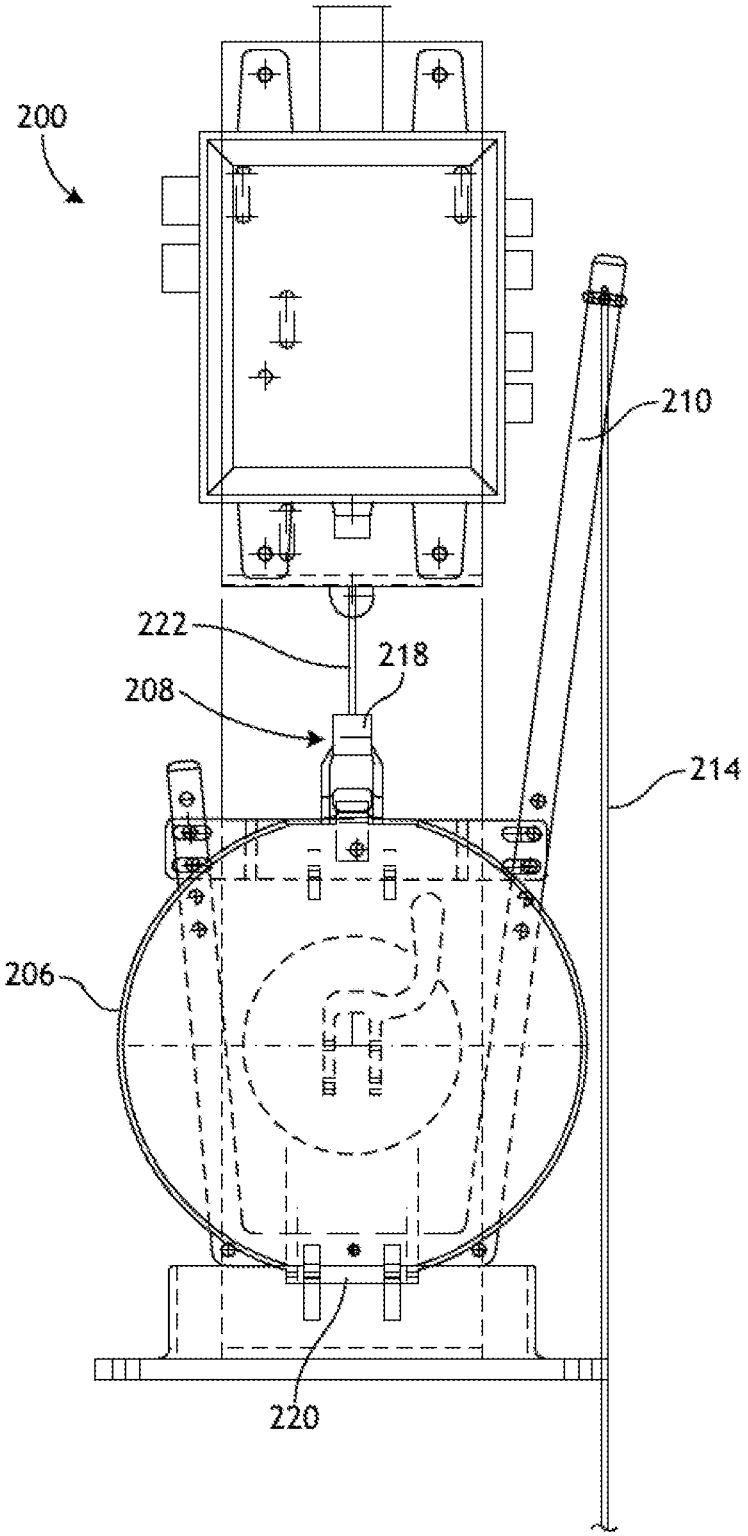

FIGS. 2A-2C depict the access hatch 202 closed or otherwise in a closed position. In contrast, FIGS. 3A-3C are side, top and front views, respectively, of the system 200 and depict the access hatch 202 open or otherwise moved to an open position. With continued reference to FIGS. 2A-2C, and additional reference to FIGS. 3A-3C, example operation of the system 200 is now provided. The system 200 is advantageous in that it allows a tank operator (worker) to open the access hatch 202 while located on the ground 118 (FIG. 1), and thus safely away from any harmful off-gas discharges that may escape from the access hatch 202 upon opening the lid 206.

To open the lid 206 of the access hatch 202, a tank operator (worker) pulls down on the pull cable 214. Since the arm 210 extends past the outer periphery of the storage tank 100 (FIG. 1), the pull cable 214 will extend down toward the ground 118 (FIG. 1) to be accessible by the tank operator located on the ground 118. Pulling down on the pull cable 214 places a downward load on the arm 210, and the arm 210 transmits the downward load to the frame 250 (FIG. 2B). The frame 250 distributes the downward load over the lid 206, which forces the lid 206 downward and simultaneously lowers the latch 208 to allow the catch 218 to disengage from the pin 220. As the latch 208 is lowered, the constant force provided on the latch 208 by the weight cable 222 causes the latch 208 to pivot to the unlatched position where the catch 218 is released from the pin 220. In some embodiments, the latch 208 may be spring-loaded and naturally biased to the unlatched position. In other embodiments, or in addition thereto, the weight of the counterweight 234 acting on the latch 208 through the weight cable 222 is sufficient to cause the latch 208 to pivot to the unlatched position once the user pulls down on the arm 210 via the pull cable 214.

With the latch 208 disengaged from the pin 220, the counterweight 234 is then free to descend in the direction A (FIG. 2A). As the counterweight 234 descends, the weight cable 222 feeds through the sheave(s) 232 of the pulley system 224 and simultaneously pulls on the lid 206 at the latch 208, which is correspondingly urged to pivot toward the open position.

In FIG. 3A, the counterweight 234 is depicted as having descended within the weight guard 236, which pulls the weight cable 222 through the sheave(s) 232 and thereby pivots the lid 206 away from the base 204 and to the open position. As the lid 206 pivots to the open position, the arm 210 is correspondingly raised and pulls a portion of the pull cable 214 upward, but the pull cable 214 has a length sufficient that it is still accessible by the tank operator (worker) at the ground 118 (FIG. 1) when the access hatch 202 is in the open position.

To return the access hatch 202 to the closed position, the tank operator can manually close the lid 206 while located on the roof 104 (FIG. 1). As the lid 206 pivots back to the closed position, the counterweight 234 is correspondingly raised within the weight guard 236 as connected to the weight cable 222, as indicated by the arrow B in FIG. 3A. Once the latch 208 reaches the pin 220, the worker may then manually engage the catch 218 on the pin 220 and thereby secure the latch 208 in place, and thus secure the access hatch 202 in the closed position.

Alternatively, the access hatch 202 can be returned to the closed position by the tank operator located on the ground 118 (FIG. 1). To accomplish this, the tank operator again pulls on the pull cable 214, which places a load on the lid 206 through the interconnected arm 210. As the pull cable 214 is retracted, the lid 206 pivots back to the closed position, and the counterweight 234 is correspondingly raised within the weight guard 236 as connected to the weight cable 222, as indicated by the arrow B. Once the lid 206 pivots back down, the flow of escaping off-gases will be prevented, which allows the tank operator to approach the access hatch 202 and safely manually re-latch and secure the lid 206.

In addition to being able to remotely open the access hatch 202 from the ground 118 (FIG. 1), the system 200 also includes the monitoring system 242 arranged adjacent the access hatch 202. In some embodiments, as indicated above, the monitoring system 242 may include one or more sensors or gauges configured to monitor the state of the access hatch 202. For example, the monitoring system 242 may include one or more proximity sensors 256 (FIGS. 2A and 3A) capable of detecting the general position of the lid 206 and verifying if the lid 206 is securely attached to the base with the latch 208. In such embodiments, the proximity sensors 256 may be able to detect if the catch 218 has located and engaged the pin 220, or if the lid 206 is properly situated in a predetermined configuration relative to the base 204, thus indicative of the lid 206 being secured to the base 204.

In addition thereto, the monitoring system 242 may also include one or more sensors or gauges configured to monitor the area around the access hatch 202 for off-gases or any other emissions that may be toxic or harmful to humans. In such embodiments, the monitoring system 242 may include one or more environment sensors 258 (FIGS. 2A and 3A) configured to monitor the environment (air) around the access hatch 202. The environment sensor(s) 258 may operate continuously, may take measurements periodically based on a predetermined sampling interval, or may be manually operated as needed.

The environment sensor(s) 258 may be able to detect chemical compounds including, but not limited to, off-gases of hydrogen sulfide, pentane, hexane, benzene, xylene, methane, ethane, propane, butane, toluene, oxygen, heptanes, hexanes, and combinations thereof. The environment sensor(s) 258 may utilize any detection method for detecting these compounds, for example, non-dispersive infrared (NDIR), photo ionization detectors (PIDs), differential absorption infrared laser (DIAL), differential optical absorption spectrometry (DOAS), Fourier-transform infrared (FT-IR), back scatter absorption gas imaging (BAGI), electro-environment sensors, metal oxide semiconductor sensors, thermal sensors, or any combination thereof. In some embodiments, the environment sensor(s) 258 may include a lower explosive limit (LEL) sensor.

Accordingly, the environment sensor(s) 258 may prove advantageous in determining if a large concentration of harmful off-gases and vapors is released when the access hatch 202 is opened. Moreover, the environment sensor(s) 258 may also operate to detect any leaks in the access hatch 202, which may be caused by wear, corrosion, or improper securing of the access hatch 202 after sampling.

In some embodiments, the monitoring system 242 may also include an alert system 260 (FIGS. 2A and 3A) configured to provide tank operators (workers) with one or more alarms or alerts regarding conditions around the access hatch 202, thus ensuring that tank operators do not approach the access hatch 202 when the environment is unsuitable for humans. Any alarms or alerts (referred to collectively herein as "alerts") provided through the alert system 260 may be perceivable or otherwise detectable by a tank operator located on the ground 118 (FIG. 1). In some embodiments, for example, the alert may comprise a visual alert, such as flashing or colored lights perceivable by the worker. In other embodiments, or in addition thereto, the alert may comprise an audible alert, such as a warning siren or an audible message conveyed to and otherwise hearable by the worker. In yet other embodiments, or in addition thereto, the alert may comprise a digital alert sent to the worker via email, text, etc.

The alert system 260 may be binary (i.e., the alerts are either "on" or "off") or non-binary (e.g., the alert state may change). In embodiments where the alert system 260 is binary, for example, the alert system 260 may be programmed to trigger an alert based on meeting different situational criteria or sets of criteria including, but not limited to, whether the lid 206 is open or closed, time since the lid 206 was last opened or closed, concentration of specific off-gases, concentration of total off-gases, oxygen levels, air temperature, wind direction, or any combination thereof. In such embodiments, the alert system 260 may be programmed to indicate if the VOC concentration is above, and/or if the oxygen level is below, a predetermined safety threshold limit where a worker may experience unconsciousness if the air containing said VOC concentration is inhaled.

In contrast, in embodiments where the alert system 260 is non-binary, the state of the alerts may be based on the same criteria listed above for binary systems, but change when criteria conditions change. For example, the auditory nature of the alert may change (e.g., volume, tone, pulsing, etc.), the visual nature may change (e.g., color, flashing rate, brightness, etc.), or a combination of both aspects may change. In such embodiments, alert changes may be triggered when VOC levels are high and then change in some detectable manner when the VOC concentration is at a lower and safe level.

In other embodiments, the monitoring system 242 may be programmed to trigger an alert if the off-gas concentration is above a leak threshold that indicates unchecked release of off-gases into the atmosphere. The alert trigger may further depend on whether the lid 206 is closed or open. This programming may be useful to signal that a leak may be present in the access hatch 202. In yet other embodiments, the monitoring system 242 may be programmed with a leak threshold and trigger an alert if the time since the lid 206 was opened but not yet closed (or latched) exceeds a predetermined time period and the off-gas concentration exceeds a certain threshold. This programming may be useful to signal that the lid 206 was left open or was not secured fully.

Accordingly, the monitoring system 242 may advantageously indicate to a worker when it is safe to approach the access hatch 202. Using the system 200 for remotely opening the access hatch 202 in conjunction with the monitoring system 242 can improve worker safety by allowing the worker to open the access hatch 202 without being in the vicinity of potentially escaping toxic gases, and warning the worker if the environment near the access hatch 202 has unsafe levels of such gases. When the access hatch 202 is opened by the worker located on the ground 118 (FIG. 1), the environment sensor(s) 258 in the monitoring system 242 placed near the access hatch 202 will detect if a dangerous level of toxic gases has been released.

Figure 4:
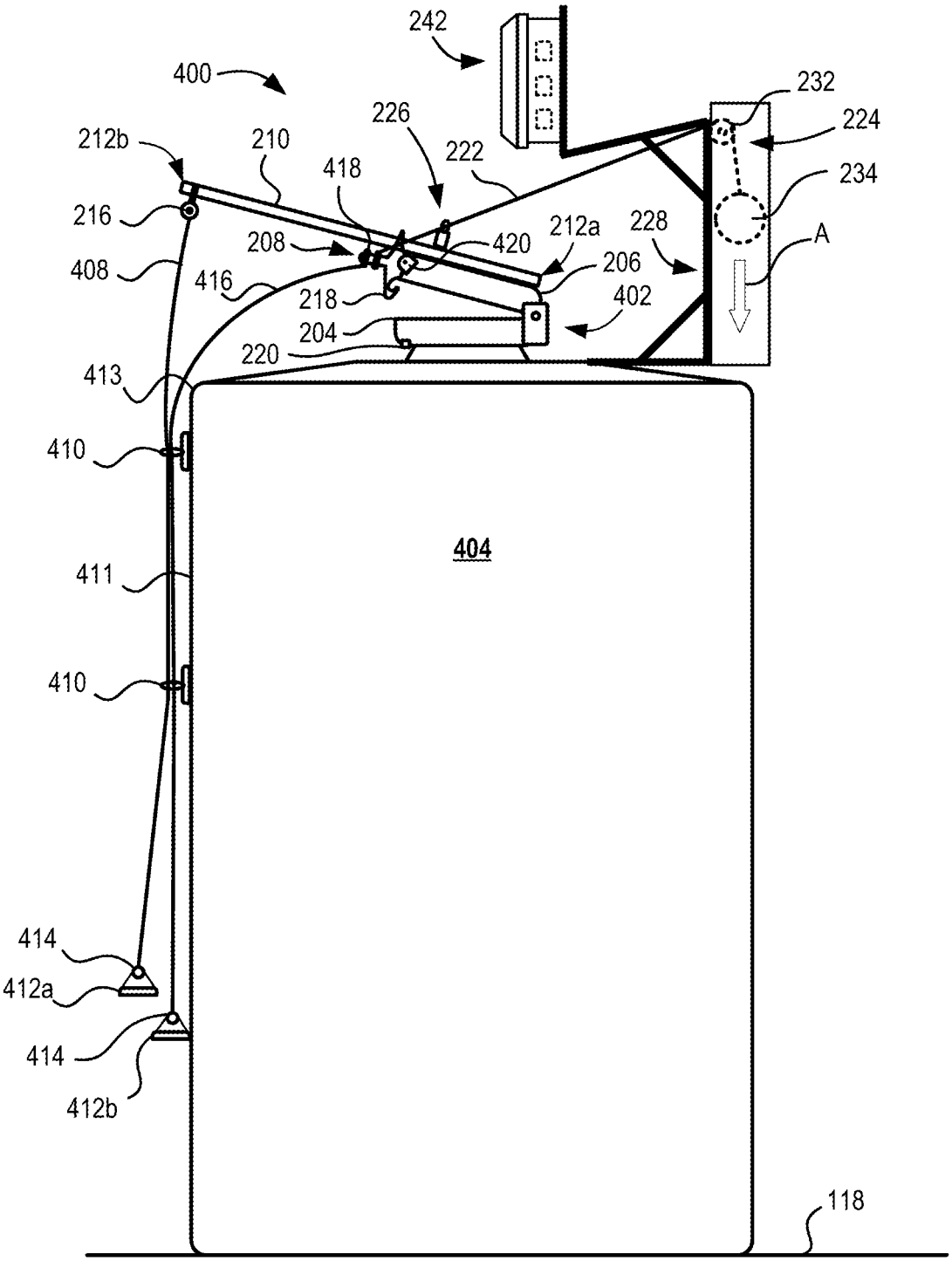
FIG. 4 is a side view of another example system for remotely opening, closing, and latching an access hatch.

FIG. 4 is a side view of an example system 400 for remotely opening, closing, and latching an access hatch 402. The system 400 may be similar in some respects to the system 200 of FIGS. 2A-2C and 3A-3C and therefore may be best understood with reference thereto, where like reference numerals will refer to like components not described again in detail. The system 400 may be used in conjunction with a storage tank 404, which may be the same as or similar to the storage tank 100 of FIG. 1. An access hatch 402 may be installed on or may otherwise form an integral part of the storage tank 404, but the system 400 may alternately be used in conjunction with other types of access hatches, and the access hatch 402 may alternately be used in conjunction with other types of storage tanks 404. Consequently, the system 400 is not limited to use with the access hatch 402 or the storage tank 404 described herein.

The access hatch 402 may comprise an existing "thief hatch" and the system 400 can be retrofitted onto the access hatch 402. In other embodiments, however, the system 400 may form an integral part of the design and manufacture of the access hatch 402, without departing from the scope of the disclosure. Similar to the access hatch 202 of FIGS. 2A-2C, the access hatch 402 includes the base 204, the lid 206 pivotably coupled to the base 204, and the latch 208 used to secure the lid 206 to the base 204 in a closed position. The system 400 may further include the monitoring system 242, as generally described above.

The system 400 also includes the elongate arm 210 having the opposing proximal and distal ends 212*a*, 212*b*, where the arm 210 is operatively coupled to the lid 206 at or near the proximal end 212*a*. As illustrated, the arm 210 extends from the lid 206 and exhibits a length sufficient to extend past the sidewall 411 (e.g., an outer perimeter) of the storage tank 404. In other embodiments, however, the arm 210 may not extend past the outer perimeter of the storage tank 404, without departing from the scope of the disclosure.

A pull cable 408 may be attached to the arm 210 at or near the distal end 212*b*, and may be the same as or similar to the pull cable 214 of FIGS. 2A-3C. The pull cable 408 may be operatively coupled to the arm 210 at the attachment mechanism 216.

The latch 208 provides the catch 218, which is matable with the pin 220 provided on the base 204. In some embodiments, the latch 208 is spring-loaded and otherwise biased toward a position where the catch 218 is able to naturally locate and mate with the pin 220. In other embodiments, however, the latch 208 may not be spring-loaded, without departing from the scope of the disclosure. The weight cable 222 is operatively coupled to the latch 208 and constantly urges the latch 208 to the unlatched position, where the catch 218 is released from the pin 220.

The weight cable 222 extends from the latch 208 and to the pulley system 224, which may also be included in the system 400. As described above, the pulley system 224 is mounted to the support frame 228, which is operatively coupled to the access hatch 402 and, more particularly, to the base 204. The pulley system 224 includes the one or more sheaves 232 and the counterweight 234 coupled to the end of the weight cable 222. Once the latch 208 is detached from the pin 220, the gravitational pull of the counterweight 234 coupled to the end of the weight cable 222 will act (pull) on the weight cable 222 in the direction indicated by the arrow A, and the weight cable 222 will correspondingly exert a force on the lid 206 at the latch 208 to open the access hatch 402.

To open the access hatch 402, a tank operator on the ground 118 may apply an initial downward force on the lid 206 by pulling down on the pull cable 408. This allows the latch 208 to transition from the latched position to the unlatched position, where the latch 208 disengages from the pin 220 to enable the access hatch 402 to open. Once the latch 208 transitions to the unlatched position, the gravitational pull of the counterweight 234 helps the lid 206 pivot to the opened position. Moreover, in some cases, the gravitational pull of the counterweight 234 may be contested (slowed) by the tank operator maintaining a grip on the pull cable 408 and thereby controlling the opening movement. In some cases, if needed, the tank operator can reverse movement of the lid 206 and pivot the lid 206 back to the closed position by pulling on the pull cable 408.

As illustrated, the pull cable 408 may extend downward through one or more cable guides 410 disposed on the sidewall 411 of the storage tank 404. In some embodiments, the cable guides 410 may be magnetically attached to the side of the storage tank 404. This allows the cable guides 410 to be selectively positioned, repositioned, or removed as desired. In other embodiments, however, the cable guides 410 may be fixed to the sidewall 411, such as via welding, brazing, one or more mechanical fasteners, an industrial adhesive, or by other means capable of providing permanent placement. During operation of the system 400, the cable guides 410 help to maintain position and alignment of the pull cable 408. Further, the cable guides 410 may position (guide) the pull cable 408 away from a corner 413 of the storage tank 404 to prevent the pull cable 408 from rubbing or scraping against the corner during operation.

A first handle 412*a* may be attached to the end of the pull cable 408 at or near the ground 118 and otherwise at a location where a tank operator may be able to reach and grasp onto the first handle 412*a*. The first handle 412*a* may include an attachment mechanism 414 that couples the first handle 412*a* to the pull cable 408. As with the attachment mechanism 216, the attachment mechanism 414 may comprise an eyebolt or the like, but could alternatively comprise any other type of attachment device or apparatus capable of coupling the first handle 412*a* to the pull cable 408, such as a swivel lifting ring. The first handle 412*a* may be manually grasped by a tank operator, who can then apply a downward force on the pull cable 408, which may be transferred to the arm 210 for the initial opening or closing of the access hatch 402.

Unlike the system 200 of FIGS. 2A-3C, the system 400 further includes a second or "latching" cable 416, which may be used for remote actuation (latching or re-latching) of the latch 208. As illustrated, the latching cable 416 may be operatively coupled to the latch 208, such as being attached to a projection 418 extending from a portion of the latch 208. Alternatively, or in addition thereto, the latching cable 416 may be operatively coupled to the latch 208 at one or more holes (not shown) defined in the latch 208. The latching cable 416 may be made of any of the materials mentioned herein for the pull cable 408. Moreover, the latching cable 416 may similarly extend downward through the cable guides 410 disposed on the sidewall 411 of the storage tank 404. In some embodiments, the cable guides 410 may be sized to receive both the pull and latching cables 408, 416, such that both cables are retained in a desired position. In other embodiments, however, the latching cable 416 may extend through one or more additional cable guides independent of the pull cable 408.

A second handle 412*b* may be operatively coupled to an opposing end of the latching cable 416. The second handle 412*b* may similarly include an attachment mechanism 414, which couples the second handle 412*b* to the latching cable 416. The second handle 412*b* may be manually grasped by a tank operator and forced downward, which applies a downward force on the latching cable 416 that is transferred to the latch 208, which causes the catch 218 to pivot towards the pin 220. More specifically, the latch 208 may be pivotably attached to the lid 206 at a pivot pin 420, and manually pulling down on the latching cable 416 may cause the latch 208 to pivot about the pivot pin 420 and toward the latched position, where the catch 218 is able to re-engage with the pin 220.

Example operation of the system 400 is now provided. When it is desired to open the access hatch 402, a tank operator may approach the storage tank 400 and locate the first handle 412*a*. The first and second handles 412*a,b* may be easily identifiable and distinguishable by a tank operator in a variety of ways. In some embodiments, for example, the handles 412*a,b* and/or the cables 408, 416 may exhibit different colors, where one color (e.g., green) may signify "open", and a second color (e.g., red) may signify "close". In such embodiments, the first handle 412*a* and/or the pull cable 408 may be green, and the second handle 412*b* and/or the latching cable 416 may be red. In other embodiments, however, the handles 412*a,b* may be marked to be easily distinguishable. In such embodiments, the first handle 412*a* may have the word "OPEN" depicted thereon, while the second handle 412*b* may have the word "CLOSE" depicted thereon. In yet other embodiments, the first and second handles 412*a,b* may be loosely secured against the sidewall 411 adjacent signage provided on the sidewall 411 that indicates that the first handle 412*a* is to be pulled to open the access hatch 402, and the second handle 412*b* is to be pulled to close the access hatch 402.

Once the first handle 412*a* is located and grasped, the tank operator may pull down on the first handle 412*a* to provide a downward force to the pull cable 408. The downward force is transferred to the lid 206 via the arm 210, which causes the lid 206 to be urged towards the base 204, thereby allowing the catch 218 to move out of engagement with the pin 220. As described above, in some embodiments, the catch 218 may naturally move out of engagement with the pin 220 by the pull force exerted on the latch 208 from the counterweight 234. In other embodiments, however, or in addition thereto, the latch 208 may be spring-biased to naturally disengage from the pin 220.

Once the latch 208 is detached from the pin 220, the gravitational pull of the counterweight 234 will act (pull) on the weight cable 222 and correspondingly exert a force on the lid 206 at the latch 208 to pivot the access hatch 402 to the opened position. If needed, the tank operator may be able to manually control the opening movement of the lid 206 by maintaining a grasp on the first handle 412*a* until the lid 206 reaches the fully open position.

When it is desired to close the access hatch 402, the tank operator may again pull down on the first handle 412*a* to overcome the gravitational pull of the counterweight 234, and thereby pivot the lid 206 back to the closed position in a controlled movement. Once tank operator is no longer unable to pull the first handle 412*a* in the downward direction, that may be a positive indication that the lid 206 has successfully reached the closed position.

Upon reaching the closed position, the latch 208 may then be manually pivoted back to the latched position. This may be accomplished by the tank operator on the ground 118 by manually locating and grasping the second handle 412*b*. In particular, the tank operator may pull down on the second handle 412*b* and otherwise provide a downward force to the latching cable 416. The downward force applied to the latching cable 416 acts on the latch 208, thereby causing the latch 208 to pivot back to the latched position on the pivot pin 420 where the catch 218 can engage with the pin 220. The tank operator may then release both handles 412*a,b*, and the latch 208 may retain the access hatch 402 in the closed position.

The system 400 may prove advantageous for a variety of reasons.

For example, if unsafe conditions are detected above the storage tank 404 and the access hatch 402, an operator may be able to open and fully close the access hatch 402 from the ground 118 and otherwise without entering the unsafe conditions. Through the provision of the pull cable 408 and the latching cable 416, the access hatch 402 may be remotely opened, remotely closed, and remotely latched from a safe distance.

Embodiments disclosed herein include:

A. A storage tank includes a floor, a roof, a sidewall extending between the floor and the roof, an access hatch provided on the roof and having a base, a lid pivotably coupled to the base, and a latch configured to secure the lid to the base in a closed position, and a system for remotely opening and closing the access hatch. The system includes an elongate arm having a proximal end operatively coupled to the lid, a pull cable attached to a distal end of the elongate arm and extending toward a ground adjacent the storage tank, and a latching cable attached to the latch and extending toward the ground adjacent the storage tank, wherein pulling on the pull cable from the ground releases the latch and allows the lid to pivot from the closed position to an open position, wherein pulling on the pull cable from the ground when the lid is in the open position moves the lid back to the closed position, and wherein pulling on the latching cable when the lid is in the closed position actuates the latch to secure the lid to the base in the closed position.

B. A system for remotely opening an access hatch of a storage tank includes an elongate arm having a proximal end configured to be operatively coupled to a lid of the access hatch, the access hatch further including a latch configured to secure the lid to a base of the access hatch in a closed position, a pull cable attachable to a distal end of the elongate arm and being extendable toward a ground adjacent the storage tank, and a latching cable attachable to the latch and being extendable toward the ground adjacent the storage tank, wherein pulling on the pull cable from the ground releases the latch and allows the lid to pivot from the closed position to an open position, wherein pulling on the pull cable from the ground when the lid is in the open position moves the lid back to the closed position, and wherein pulling on the latching cable when the lid is in the closed position actuates the latch to secure the lid to the base in the closed position.

C. A method of operating an access hatch of a storage tank includes locating and manually pulling on a pull cable attached to an elongate arm operatively coupled to a lid of the access hatch and thereby placing a downward load on the elongate arm, transmitting the downward load on the elongate arm to the lid and thereby urging the lid toward a base of the access hatch, manually pulling on a latching cable attached to a latch pivotably mounted to the lid and thereby placing a downward load on the latch, and pivoting the latch toward a latched position and thereby engaging a catch of the latch with a pin of the base and thereby securing the access hatch in a closed position.

Each of embodiments A, B, and C may have one or more of the following additional elements in any combination: Element 1: wherein the system further includes a first handle attached to the pull cable at or near the ground and a second handle attached to the latching cable at or near the ground. Element 2: further comprising one or more cable guides disposed on the sidewall of the storage tank, wherein at least one of the pull and latching cables extend through the one or more cable guides. Element 3: wherein the system further includes a support frame operatively coupled to the access hatch, a pulley system mounted to the support frame, a weight cable having a first end operatively coupled to the latch and extending to the pulley system, and a counterweight coupled to a second end of the weight cable, wherein the counterweight causes the weight cable to constantly urge the latch to an unlatched position, and wherein, once the latch becomes unlatched, gravitational pull of the counterweight acts on the weight cable to pivot the lid to the open position. Element 4: wherein the system further includes a monitoring system mounted to the support frame adjacent the access hatch and including one or more sensors. Element 5: wherein the monitoring system further includes an alert system configured to provide alerts regarding the access hatch and conditions of an environment around the access hatch based on measurements obtained by the one or more sensors. Element 6: wherein the distal end of the elongate arm extends past an outer perimeter of the storage tank.

Element 7: further comprising a first handle attached to the pull cable at or near the ground and a second handle attached to the latching cable at or near the ground. Element 8: further comprising a support frame configured to be operatively coupled to the access hatch, a pulley system mounted to the support frame, a weight cable having a first end configured to be operatively coupled to the latch and extending to the pulley system, and a counterweight coupled to a second end of the weight cable, wherein the counterweight causes the weight cable to constantly urge the latch to an unlatched position, and wherein, pulling on the first handle unlatches the latch, and wherein once the latch becomes unlatched, gravitational pull of the counterweight acts on the weight cable to pivot the lid to the open position. Element 9: further comprising a weight guard coupled to the support frame, the pulley system and the counterweight being arranged within the weight guard. Element 10: further comprising a monitoring system mounted to the support frame adjacent the access hatch and including one or more sensors. Element 11: wherein the one or more sensors include one or more proximity sensors configured to monitor a state of the lid between the closed and open positions. Element 12: wherein the one or more sensors include one or more environment sensors configured to monitor an environment around the access hatch and detect one or more off-gases.

Element 13: wherein the monitoring system further includes an alert system configured to provide alerts regarding the access hatch and conditions of an environment around the access hatch. Element 14: wherein the alerts are selected from the group consisting of a visual alert, an audible alert, a digital alert, and any combination thereof. Element 15: wherein the distal end of the elongate arm is extendable past an outer perimeter of the storage tank. Element 16: further comprising with the access hatch in the closed position, manually pulling on the pull cable and thereby placing a second downward load on the elongate arm, transmitting the second downward load on the elongate arm to the lid and thereby disengaging the catch from the pin, the latch being coupled to a first end of a weight cable that extends to a pulley system, allowing a counterweight coupled to a second end of the weight cable to descend under gravitational forces and thereby pulling on the weight cable coupled to the latch, and pivoting the lid toward an open position as the counterweight descends and the weight cable pulls on the lid at the latch. Element 17: further comprising manually controlling movement of the lid toward the open position by maintaining a grasp on the pull cable until the lid reaches the open position.

By way of non-limiting example, exemplary combinations applicable to A, B, and C include: Element 4 with Element 5; Element 8 with Element 9; Element 8 with Element 10; Element 10 with Element 11; Element 10 with Element 12; Element 10 with Element 13; Element 13 with Element 14; and Element 16 with Element 17.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A storage tank, comprising:

a floor;

a roof;

a sidewall extending between the floor and the roof;

an access hatch provided on the roof and having a base, a lid pivotably coupled to the base, and a latch configured to secure the lid to the base in a closed position; and a system for remotely opening and closing the access hatch, the system including:

an elongate arm having a proximal end operatively coupled to the lid, a pull cable attached to a distal end of the elongate arm and extending toward a ground adjacent the storage tank, and a latching cable attached to the latch and extending toward the ground adjacent the storage tank, wherein pulling on the pull cable from the ground releases the latch and allows the lid to pivot from the closed position to an open position, wherein pulling on the pull cable from the ground when the lid is in the open position moves the lid back to the closed position, and wherein pulling on the latching cable when the lid is in the closed position actuates the latch to secure the lid to the base in the closed position.

2. The storage tank of claim 1, wherein the system further includes a first handle attached to the pull cable at or near the ground and a second handle attached to the latching cable at or near the ground.

3. The storage tank of claim 1, further comprising one or more cable guides disposed on the sidewall of the storage tank, wherein at least one of the pull and latching cables extend through the one or more cable guides.

4. The storage tank of claim 1, wherein the system further includes:

a support frame operatively coupled to the access hatch;

a pulley system mounted to the support frame;

a weight cable having a first end operatively coupled to the latch and extending to the pulley system; and a counterweight coupled to a second end of the weight cable, wherein the counterweight causes the weight cable to constantly urge the latch to an unlatched position, and wherein, once the latch becomes unlatched, gravitational pull of the counterweight acts on the weight cable to pivot the lid to the open position.

5. The storage tank of claim 4, wherein the system further includes a monitoring system mounted to the support frame adjacent the access hatch and including one or more sensors.

6. The storage tank of claim 5, wherein the monitoring system further includes an alert system configured to provide alerts regarding the access hatch and conditions of an environment around the access hatch based on measurements obtained by the one or more sensors.

7. The storage tank of claim 1, wherein the distal end of the elongate arm extends past an outer perimeter of the storage tank.

8. A system for remotely opening an access hatch of a storage tank, comprising:

an elongate arm having a proximal end configured to be operatively coupled to a lid of the access hatch, the access hatch further including a latch configured to secure the lid to a base of the access hatch in a closed position;

a pull cable attachable to a distal end of the elongate arm and being extendable toward a ground adjacent the storage tank; and a latching cable attachable to the latch and being extendable toward the ground adjacent the storage tank, wherein pulling on the pull cable from the ground releases the latch and allows the lid to pivot from the closed position to an open position, wherein pulling on the pull cable from the ground when the lid is in the open position moves the lid back to the closed position, and wherein pulling on the latching cable when the lid is in the closed position actuates the latch to secure the lid to the base in the closed position.

9. The system of claim 8, further comprising a first handle attached to the pull cable at or near the ground and a second handle attached to the latching cable at or near the ground.

10. The system of claim 8, further comprising:

a support frame configured to be operatively coupled to the access hatch;

a pulley system mounted to the support frame;

a weight cable having a first end configured to be operatively coupled to the latch and extending to the pulley system; and a counterweight coupled to a second end of the weight cable, wherein the counterweight causes the weight cable to constantly urge the latch to an unlatched position, and wherein, pulling on the first handle unlatches the latch, and wherein once the latch becomes unlatched, gravitational pull of the counterweight acts on the weight cable to pivot the lid to the open position.

11. The system of claim 10, further comprising a weight guard coupled to the support frame, the pulley system and the counterweight being arranged within the weight guard.

12. The system of claim 10, further comprising a monitoring system mounted to the support frame adjacent the access hatch and including one or more sensors.

13. The system of claim 12, wherein the one or more sensors include one or more proximity sensors configured to monitor a state of the lid between the closed and open positions.

14. The system of claim 12, wherein the one or more sensors include one or more environment sensors configured to monitor an environment around the access hatch and detect one or more off-gases.

15. The system of claim 12, wherein the monitoring system further includes an alert system configured to provide alerts regarding the access hatch and conditions of an environment around the access hatch.

16. The system of claim 15, wherein the alerts are selected from the group consisting of a visual alert, an audible alert, a digital alert, and any combination thereof.

17. The system of claim 8, wherein the distal end of the elongate arm is extendable past an outer perimeter of the storage tank.

18. A method of operating an access hatch of a storage tank, comprising:

locating and manually pulling on a pull cable attached to an elongate arm operatively coupled to a lid of the access hatch and thereby placing a downward load on the elongate arm;

transmitting the downward load on the elongate arm to the lid and thereby urging the lid toward a base of the access hatch;

manually pulling on a latching cable attached to a latch pivotably mounted to the lid and thereby placing a downward load on the latch; and pivoting the latch toward a latched position and thereby engaging a catch of the latch with a pin of the base and thereby securing the access hatch in a closed position.

19. The method of claim 18, further comprising:

with the access hatch in the closed position, manually pulling on the pull cable and thereby placing a second downward load on the elongate arm;

transmitting the second downward load on the elongate arm to the lid and thereby disengaging the catch from the pin, the latch being coupled to a first end of a weight cable that extends to a pulley system;

allowing a counterweight coupled to a second end of the weight cable to descend under gravitational forces and thereby pulling on the weight cable coupled to the latch; and pivoting the lid toward an open position as the counterweight descends and the weight cable pulls on the lid at the latch.

20. The method of claim 19, further comprising manually controlling movement of the lid toward the open position by maintaining a grasp on the pull cable until the lid reaches the open position.

* * * * *